US006886214B2

(12) United States Patent
Lee et al.

(10) Patent No.: US 6,886,214 B2
(45) Date of Patent: May 3, 2005

(54) STEAM JET APPARATUS FOR A VACUUM CLEANER

(75) Inventors: Hyun-ju Lee, Jeonju (KR); Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 370 days.

(21) Appl. No.: 10/201,938

(22) Filed: Jul. 25, 2002

(65) Prior Publication Data

US 2003/0159228 A1 Aug. 28, 2003

(30) Foreign Application Priority Data

Feb. 28, 2002 (KR) ..... 2002-11044

(51) Int. Cl.[7] ..... A47L 7/00; F17C 7/04

(52) U.S. Cl. ..... 15/320; 15/322; 15/246.2; 392/403; 392/404

(58) Field of Search ..... 15/320, 321, 322, 15/344, 246.2; 392/394, 403, 404

(56) References Cited

U.S. PATENT DOCUMENTS

| | | | | |
|---|---|---|---|---|
| 1,783,610 A | * | 12/1930 | Edmund | 132/212 |
| 2,259,545 A | * | 10/1941 | Black | 134/57 R |
| 2,818,485 A | * | 12/1957 | Mantell | 392/403 |
| 3,719,795 A | * | 3/1973 | Bolomier et al. | 392/404 |
| 4,288,684 A | | 9/1981 | Katou et al. | |
| 4,759,719 A | * | 7/1988 | Levenson | 434/300 |
| 5,059,287 A | * | 10/1991 | Harkey, Sr. | 203/1 |
| 6,361,752 B1 | * | 3/2002 | Demarest et al. | 422/306 |
| 6,477,890 B1 | * | 11/2002 | Hulsebus | 73/40.7 |
| 2003/0033687 A1 | * | 2/2003 | Tsen | 15/322 |

FOREIGN PATENT DOCUMENTS

| | | | |
|---|---|---|---|
| DE | 29617784 | * | 3/1997 |
| EP | 0684006 | A1 | 11/1995 |
| GB | 2276811 | A | 10/1994 |
| JP | 7-275 166 | | 10/1995 |
| JP | 9-238873 | A | 9/1997 |

* cited by examiner

*Primary Examiner*—Terrence R. Till
(74) *Attorney, Agent, or Firm*—Plumsea Law Group, LLC

(57) ABSTRACT

A steam jet apparatus for a vacuum cleaner, which can be removably mounted to a handle of a vacuum cleaner body to supply a jet of steam to a cleaning surface, and which employs the power supply and switch for the vacuum's attachment accessories. The steam jet apparatus includes a housing comprising a reservoir with an open upper side for holding water, and a steam jetting nozzle formed to be interconnected with the reservoir. A steam generating device is disposed in the reservoir, and when in operation, generates steam from the water in the reservoir. The apparatus has a cover assembly comprising an inner cover connected to the housing to cover an upper side of the reservoir and the nozzle for supporting the steam generating device. The cover assembly includes a cover connected in electrical and fluid communication with the inner cover.

18 Claims, 2 Drawing Sheets

STEAM JET APPARATUS FOR A VACUUM CLEANER

BACKGROUND OF THE INVENTION

1. Field of the Invention

The present invention relates to a steam jet apparatus for a vacuum cleaner, and more particularly, to a steam jet apparatus for use in a cleaner, which is separable and can be selectively attached to the handle of the cleaner.

2. Description of the Prior Art

Generally, a vacuum cleaner has a cleaner body for housing a driving motor that generates a suction force, a suction extension pipe connected to the cleaner body, and a suction brush disposed at one end of the suction extension pipe to draw in contaminants from a surface. A handle with an on/off switch is usually provided at one end of the suction extension pipe. The cleaner can be constructed in a manner such that the suction extension pipe with the suction brush, is connected to but movable relative to the handle, so that a user can clean narrow places like corners of a floor or a room while holding the handle. The suction brush is only one of the possible attachment accessories that may be provided.

When such a vacuum cleaner is used for cleaning, dust and foreign substances on the work surface are drawn into the cleaner body together with air. However, it is difficult for the cleaner to draw in and remove stains and microbes from floors, carpets, furniture, drapes and other surfaces.

Accordingly, it is well-known in the art that providing a jet of steam onto the surface helps remove stains and microbes, and there have been various efforts to develop wet vacuum cleaners or cleaners having steam jetting devices incorporated therein. Many of the prior attempts to address these issues have involved equipment which is bulky and heavy, and difficult to use.

SUMMARY OF THE INVENTION

The present invention has been made to overcome the above-mentioned problems of the prior art, and accordingly, it is an object of the present invention to provide a steam jet apparatus for a vacuum cleaner, which can be selectively attached to a handle of the vacuum cleaner as needed during operation.

The above object is accomplished by a steam jet apparatus for a vacuum cleaner which is removably mounted to a handle of the vacuum cleaner body. The handle is connected to a suction extension pipe which is connected to the cleaner body. The handle has a separate power supply terminal provided thereon for powering the steam jet apparatus according to the present invention. The steam jet apparatus is an attachment accessory and includes a housing comprising a reservoir with an upper opening to hold water therein, and a steam jetting nozzle interconnected to the reservoir. The steam jet apparatus also has a steam generating device disposed in the reservoir for generating steam from the water contained in the reservoir. The housing has an outer lid forming the upper portion of the housing body. In addition, an inner lid covering is provided which is connected to the housing to directly cover the upper opening of the reservoir and the steam jetting nozzle. The inner covering supports the steam generating device. The inner cover and the outer cover are coupled together with the outer cover having an electric terminal that connects the steam generating device to the power supply terminal. The outer cover is removably attached to the handle.

The inner cover has a water refill aperture, and the outer cover has a water refill conduit coupled to the aperture for replenishing the reservoir with water.

The outer cover includes an extending sidewall structure forming a cover body to cover the top of the inner cover. The outer cover has an electric terminal protruding from an external surface thereof as well as a connection protrusion protruding therefrom. The connection protrusion is sized and configured to be inserted into a mating socket on an air suction portion of the handle.

The steam generating device includes a pair of carbon bars electrically connected to the electric terminal, and supported on the inner cover.

Also, the steam jet apparatus according to the present invention preferably includes a removable extension pipe that can be connected adjacent the tip of the steam jetting nozzle to extend the distance that the jet of steam can travel.

BRIEF DESCRIPTION OF THE DRAWINGS

The above-mentioned objects and the feature of the present invention will be more apparent by describing a preferred embodiment of the present invention by referring to the appended drawings, in which.

DETAILED DESCRIPTION OF THE PREFERRED EMBODIMENT

Figure 1:
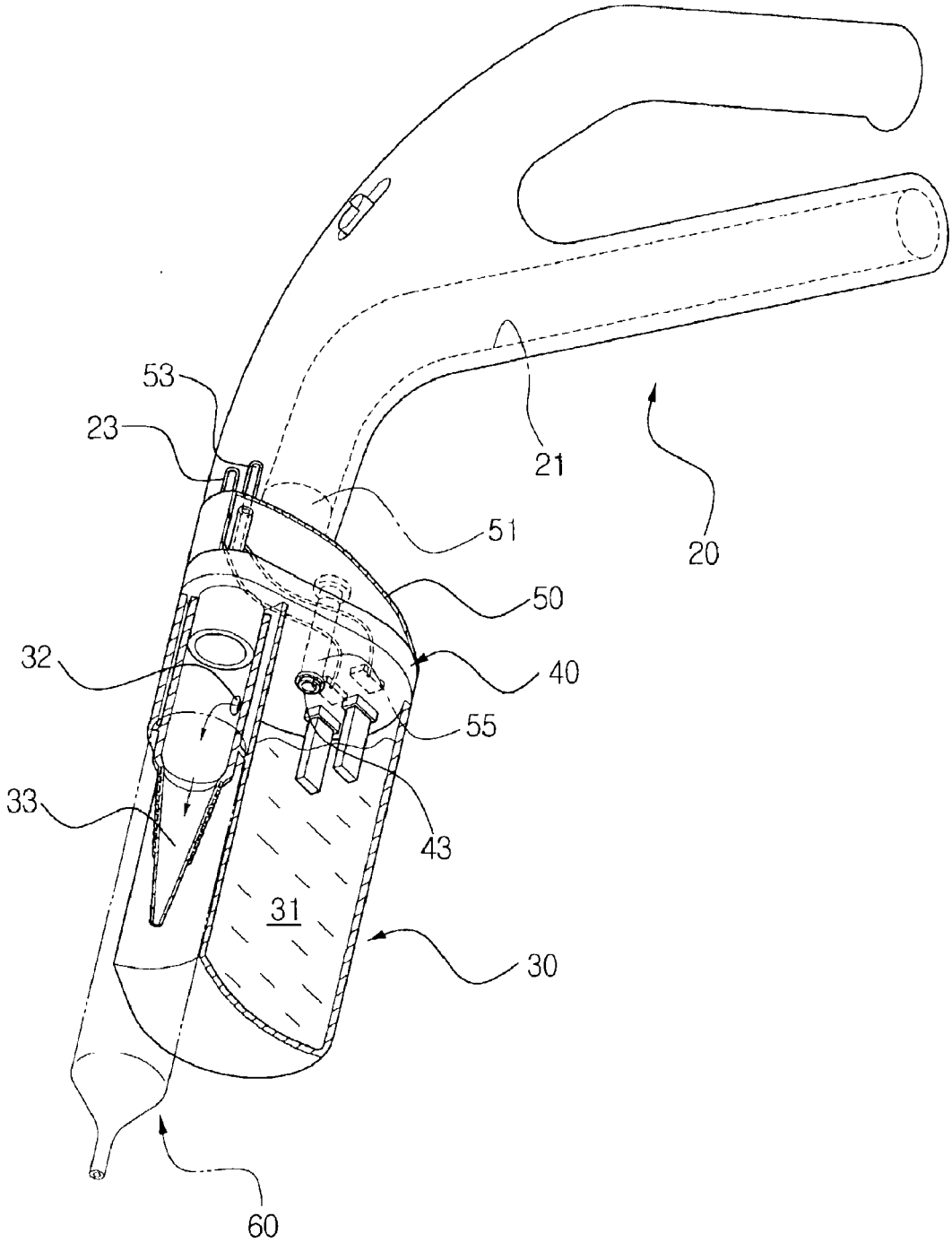
FIG. 1 is a schematic perspective view, and partial sectional, of a steam jet apparatus for a vacuum cleaner according to a preferred embodiment of the present invention.
Figure 2:
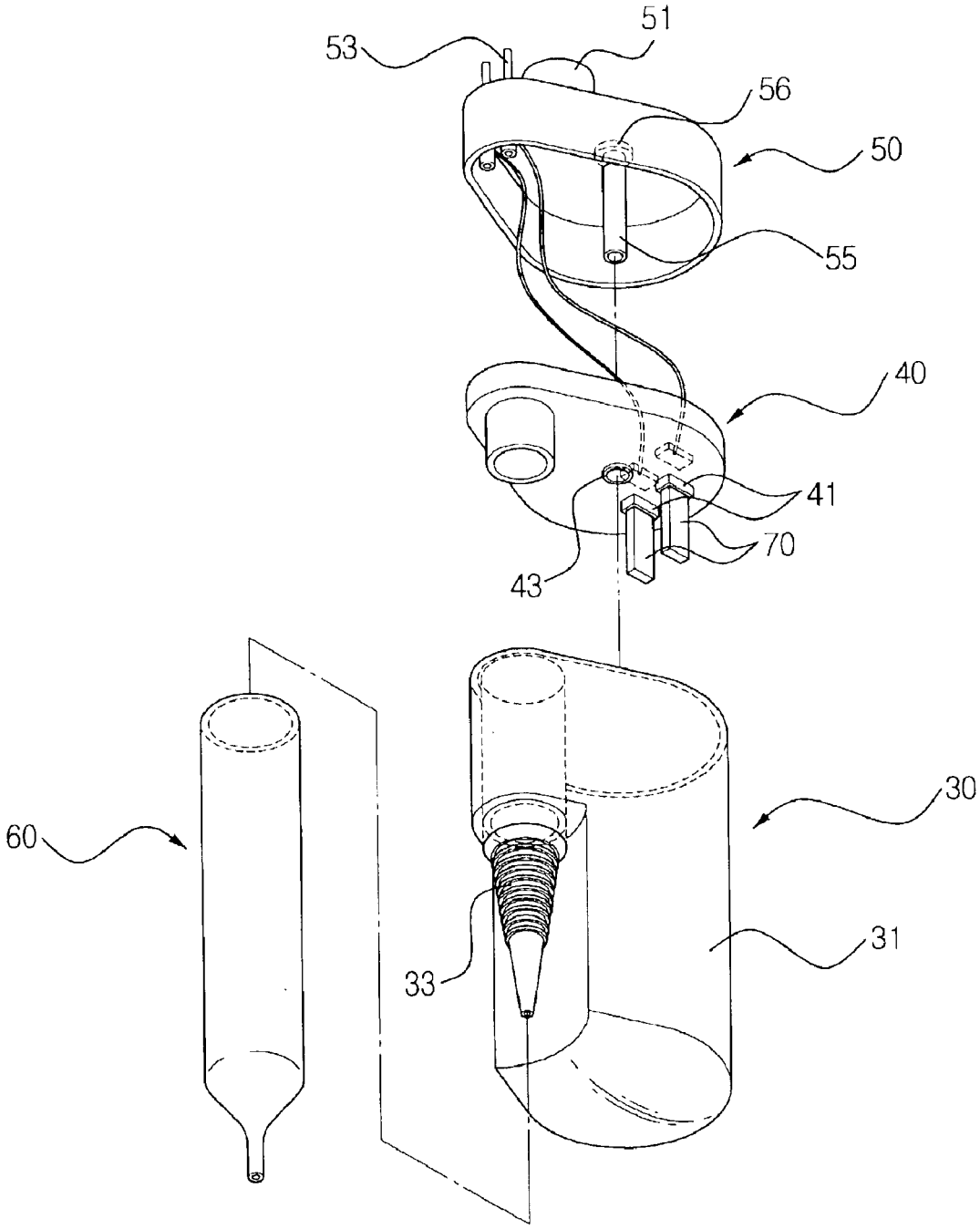
FIG. 2 is an exploded perspective view of the steam jet apparatus of FIG. 1.

Referring to FIGS. 1 and 2, a steam jet apparatus for a vacuum cleaner according to a preferred embodiment of the present invention is removably attached to a handle 20 that is provided to an air suction pipe. The air suction pipe is connected to a vacuum cleaner body (not shown).

A suction extension pipe, connected with a suction brush, is removably attached to handle 20. A power switch is provided on handle 20 for actuating the power brush. Also, a power supply terminal 23 is provided to a leading end of the handle 20.

The steam jet apparatus according to the present invention is an attachment accessory for a vacuum cleaner and includes a housing 30 having a reservoir 31 and a steam jetting nozzle 33. An inner cover 40 is connected to an outer cover 50 which forms the upper portion of the housing 30. The inner cover 40 is also connected to a steam generating device.

The upper openings of the reservoir 31 and the steam jetting nozzle 33 are open, and interconnected with each other through a steam conduit 32. The reservoir 31 is configured to preferably have a capacity of approximately 250~300 cc of water.

The steam jetting nozzle 33 is integrally formed with the housing 30,and preferably in parallel relation to a side wall of the reservoir 31. On the emitting end of steam jetting nozzle 33 a removable extension pipe 60 may be attached to extend the distance the steam travels when released through the jetting nozzle.

The inner cover 40 is connected to the housing 30 so as to cover the upper openings of the reservoir 31 and the steam jetting nozzle 33. The inner cover 40 has a connection portion 41, to which carbon bars may be connected supported thereon. The inner cover 40 has a water refill aperture 43 formed therein through which the reservoir 31 can be replenished with water.

A preferred steam generating device is supported on the inner cover 40 and includes a pair of carbon bars 70 arranged to be disposed inside reservoir 31. The carbon bars 70 are preferably made of charcoal or black lead, and emit the electricity stored in a condenser. That is, positive (+) and negative (−) charges are supplied to each of the carbon bars 70 causing the carbon bars to discharge thereby boiling the water in the immediate vicinity of the carbon bars to generate steam. This takes approximately 3 to 5 seconds.

In this embodiment, the steam generating device uses a pair of carbon bars 70 to generate steam. However, this should not be considered as limiting. For example, a simple resistance type of heating element can be used instead of carbon bars 70.

Outer cover 50 is connected to inner cover 40 and covers the upper portion of inner cover 40. Outer cover 50 includes the connection structure to removably connect the steam jet apparatus to the handle 20. The connection structure comprises a connection protrusion 51 on an external surface of outer cover 50 which is configured to be inserted into a mating socket on air suction port 21 of the handle 20. The connection protrusion 51 protrudes from an external surface of outer cover 50, and has an outer diameter corresponding to the socket of the air suction port 21 to be force-fit into the air suction port 21. Also disposed on outer cover 50 is an electrical terminal 53 which is configured to be electrically connected to the power supply terminal 23 of the handle 20 when the steam jet apparatus is connected to the handle. The electrical terminal 53 protrudes from an external surface of outer cover 50, and is electrically connected to the carbon bars 70. Accordingly, by connecting the outer cover 50 to the handle 20, the electrical connection is automatically made to supply electricity from the power supply terminal 23 to the carbon bars 70 through the electrical terminal 53. The electricity supply is turned on and off under the control of the switch disposed on the handle 20.

A water refill conduit 55, in communication with an inlet visible on the upper surface of outer cover 50, is integrally formed on the inner surface of outer cover 50. When outer cover 50 and inner cover 40 are assembled together, the water refill conduit 55 is matingly connected to water refill aperture 43 of the inner cover. At the outer end, or the inlet, of water refill conduit 55, a cap 56 is provided to cover the inlet.

As described above, the steam jet apparatus for a vacuum cleaner constructed according to the present invention has a configuration and structure that can generate steam from a relatively small amount of water keeping the apparatus of compact size and light weight. Due to its elegant structure, the steam jet apparatus can be selectively attached to the handle 20 of the cleaner with a simple manipulation to employ the steam jet only when necessary. The compact size and simple assembly which accomplishes an electrical connection provides much improved ease and convenience of use. The power supply 23 provided on the handle to power attachments such as a brush, is employed in this instance to power the steam generating device.

For example, a user cleaning the floor or carpet or other surface detaches the suction brush and connects the steam jet apparatus to the handle 20 if he/she finds a stained spot on the floor or on the carpet. Then, by turning on the switch provided on the handle 20, electricity is applied to the carbon bars 70, immediately generating the steam. The steam is expelled through the steam jetting nozzle 33. Accordingly, the user can remove any stains, dirt or microbes quickly and efficiently, by applying steam from the steam jetting apparatus.

As described above, the steam jet apparatus for a vacuum cleaner according to the present invention is compact and light weight and convenient to use. Also, the structure enables the steam jet apparatus to be selectively attached to the handle 20 of the vacuum cleaner easily and only as needed.

By providing a steam jet apparatus as an attachment type of accessory to the vacuum cleaner which can be removably mounted to the handle 20, a manufacturer can offer the steam jet apparatus to consumers at a reasonable price.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A steam jet apparatus for a vacuum cleaner adapted to be removably mounted to a handle of a vacuum cleaner body, the handle being provided to a suction extension pipe connected to the vacuum cleaner body and having a power supply terminal, the steam jetting apparatus comprises:

a housing comprising a reservoir that has an open upper side and is adapted to contain water therein, and a steam jetting nozzle interconnected with the reservoir;

a steam generating device disposed in the reservoir for generating a steam from the water held in the space portion;

an inner cover connected to the housing to cover the upper side of the reservoir and the steam jetting nozzle, the inner cover supporting the steam generating device; and an outer cover connected to the inner cover, the outer cover having an electrical terminal connected to the steam generating device and adapted to couple to the power supply terminal of the handle.

2. The steam jet apparatus of claim 1, wherein the inner cover has a water refill aperture, and the outer cover has a water refill conduit for replenishing the reservoir with water.

3. The steam jet apparatus of claim 1, wherein the outer cover comprises:

a cover body to cover an upper portion of the inner cover, and having the electrical terminal protruding from an external surface of the cover body; and a connection protrusion protruding from an external surface of the cover body adapted to be insert-connected to cover an air suction portion of the handle.

4. The steam jet apparatus of claim 1, wherein the steam generating device comprises a pair of carbon bars electrically connected to the electrical terminal, and supported on the inner cover.

5. The steam jet apparatus of claim 1, further comprising a removable jetting extension that is removably connected to the steam jetting nozzle.

6. A steam jet apparatus for a vacuum cleaner comprising:

a housing including a reservoir for containing liquid;

a cover structure forming a top wall of said housing and including an inner cover for covering and sealing said reservoir, said cover structure including an electrical terminal adapted to couple to a power supply and actuation switch of the vacuum cleaner;

a steam generating device attached to said cover structure supported by said inner cover and configured to be disposed in said reservoir when said cover structure is attached to said reservoir for heating the liquid and thereby generating steam; and a steam jetting nozzle integrally formed with and adjacent said reservoir and operatively connected thereto by a steam path and said cover structure for providing a jet of steam to a cleaning surface.

7. The apparatus of claim 6, wherein said cover structure further comprises an outer cover adapted to cover said inner cover and form a part of said housing, said outer cover being in electrical and fluid communication with said inner cover.

8. The apparatus of claim 7, wherein said outer cover comprises a refill conduit in fluid communication with a refill aperture in said inner cover.

9. The apparatus of claim 8, further comprising a cap for said refill conduit.

10. The apparatus of claim 7, wherein said electrical terminal is integrated into said outer cover.

11. The apparatus of claim 7, wherein said steam generating device comprises a pair of carbon bars in electrical communication with said electrical terminal.

12. The apparatus of claim 7, further comprising a jet extension removably attached to said steam jetting nozzle.

13. A vacuum cleaner accessory for providing steam to cleaning surfaces, the accessory comprising:

a housing including a reservoir for containing liquid;

a cover structure forming a portion of said housing and including an inner cover for covering and sealing said reservoir, said cover structure including an electrical terminal adapted to couple to an accessory power supply and actuation switch of the vacuum cleaner;

a steam generating device connected to said cover structure supported by said inner cover and configured to be disposed in said reservoir for heating the liquid and thereby generating steam when said cover structure is assembled to said reservoir; and a steam jetting nozzle integrally formed with and adjacent said reservoir and operatively connected thereto by a steam path and said cover structure for providing ajet of steam to cleaning surfaces upon actuation of the switch.

14. The vacuum cleaner accessory of claim 13, wherein said cover structure further comprises an outer cover adapted to cover said inner cover and form a part of said housing, said outer cover being in electrical and fluid communication with said inner cover.

15. The vacuum cleaner accessory of claim 14, wherein said outer cover comprises a refill conduit in fluid communication with a refill aperture in said inner cover.

16. The vacuum cleaner accessory of claim 14, wherein said steam generating device comprises a pair of carbon bars in electrical communication with said electrical terminal.

17. The vacuum cleaner accessory of claim 13, further comprising an attachment structure integral with one of said housing or said cover structure for attaching said accessory to a vacuum cleaner.

18. The vacuum cleaner accessory of claim 17, wherein said attachment structure is a protrusion integrally formed on an external surface of said cover structure, said protrusion configured to be inserted into a mating socket of the vacuum cleaner.

* * * * *